US007643379B2

(12) United States Patent
Villar et al.

(10) Patent No.: US 7,643,379 B2
(45) Date of Patent: Jan. 5, 2010

(54) INSTANTANEOUS DISPLAY MECHANISM FOR A TIMEPIECE

(75) Inventors: Ivan Villar, Bienne (CH); Gilles Rey-Mermet, Bienne (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 12/172,358

(22) Filed: Jul. 14, 2008

(65) Prior Publication Data

US 2009/0016169 A1 Jan. 15, 2009

(30) Foreign Application Priority Data

Jul. 13, 2007 (EP) ..... 07112479

(51) Int. Cl.
*G04B 19/20* (2006.01)

(52) U.S. Cl. ..... 368/38; 368/37; 368/28

(58) Field of Classification Search ..... 368/37, 368/38

See application file for complete search history.

(56) References Cited

U.S. PATENT DOCUMENTS 3,818,692 A * 6/1974 Zaugg et al. ..... 368/38
6,744,696 B2 * 6/2004 Vernay et al. ..... 368/37
7,158,448 B1 * 1/2007 Gabathuler et al. ..... 368/37
7,218,576 B1 * 5/2007 Bron ..... 368/35
2005/0254350 A1 * 11/2005 Fleury ..... 368/37
2007/0109916 A1 5/2007 Bron

FOREIGN PATENT DOCUMENTS

EP 1 785 783 A1 5/2007

OTHER PUBLICATIONS

European Search report issued in corresponding application No. EP 07 11 2479, completed Mar. 12, 2008.

* cited by examiner

*Primary Examiner*—Truc T Nguyen
*Assistant Examiner*—Jason Collins
(74) *Attorney, Agent, or Firm*—Griffin & Szipl, P.C.

(57) ABSTRACT

The mechanism includes a display member (10) fitted with a toothing (14) mounted so as to move in rotation, a drive wheel set (39) mounted so as to move in rotation, including a cam (40) and a finger (24), wherein the finger is secured in rotation to the cam to make a finger-cam assembly and the finger cooperate with the toothing to drive the display member by steps, and a spring (38) cooperating at least indirectly with the cam, wherein the cam is arranged for pivoting, the finger-cam assembly, via the slackening action of the spring, so as to drive the display member through one step. The cam is further arranged for pivoting the finger assembly, via the slackening action of the spring, so as to release the finger from the toothing after the finger cam assembly has driven the display member through one step.

12 Claims, 6 Drawing Sheets

INSTANTANEOUS DISPLAY MECHANISM FOR A TIMEPIECE

This application claims priority from European Patent Application No. 07112479.6, filed Jul. 13, 2007, the entire disclosure of which is incorporated herein by reference.

FIELD OF THE INVENTION

The invention relates to the field of horology. It concerns, more specifically, a mechanism for the instantaneous display of a time indication, such as a simple or annual calendar, an indication of the day of the week or the month.

BACKGROUND OF THE INVENTION

Such display mechanisms are well known to those skilled in the art. They generally comprise a display member which is fitted with a toothing, mobile in rotation, and driven by a wheel set arranged for delivering a brief impulse thereto, upon the passage from one time indication to the next. The wheel set is conventionally formed of a finger that cooperates with the toothing to move the latter forward one step, a cam secured to the finger in rotation, and a drive wheel which draws its drive force from a movement.

An example of this type of instantaneous display mechanism is illustrated in FIG. 1. The mechanism includes, in a conventional manner, a display member 10, formed of a date ring 12 fitted with a toothing 14, mounted to move in rotation on a plate that is not shown. The display member 10 is positioned angularly using a jumper spring 16. It is actuated in rotation by a wheel set 18, which is itself driven in rotation clockwise by an intermediate wheel 20, meshed with an hour wheel 22.

Wheel set 18 includes a finger 24 and a cam 26 secured in rotation to finger 24 and oriented angularly relative to finger 24. For this purpose, cam 26 is fitted with a stud 28 engaged in a cut out portion 30 of finger 24. Wheel set 18 further includes a drive wheel 32, meshed with intermediate wheel 20, in which an aperture 34, in the form of an arc of a circle, is made, comprising an active end 34*a* and a passive end 34*b*. Stud 28 passes through aperture 34, such that the assembly of finger 24-cam 26 forms a coupling with play, wherein the finger 24-cam 26 assembly is free to pivot at a certain angle. A lever 36 abuts on cam 26 via the action of a spring 38.

Cam 26, illustrated in FIG. 2, includes a portion 26*a* of increasing radius, a portion 26*b* of rapidly decreasing radius and a portion 26*c* of minimum radius. The various portions define, for a given point of abutment of lever 36, different angular positioning sectors of finger 24, corresponding to distinct advancement modes of the finger 24-cam 26 assembly. The first two portions 26*a* and 26*b* define two angular sectors, respectively BA and AB, delimited by two angular positions A and B of finger 24. In position A, finger 24 is oriented upstream of but released from toothing 14 and in position B, finger 24 is oriented downstream of but engaged in toothing 14. It should be noted that finger 24 is said to be "engaged" in toothing 14 if it is located on the path of toothing 14, and "released" from toothing 14 if it is located outside the path of toothing 14. The last portion 26*c* defines a stable position of the finger 24-cam 26 assembly, wherein finger 24 is in position B.

Over the first angular sector BA, the finger 24-cam 26 assembly is driven in rotation by drive wheel 32, via the action of stud 28 which cooperates with the active end 34*a* of aperture 34. Over this entire angular sector, lever 36 abuts on portion 26*a*, such that spring 38 is gradually strained via the effect of the increase in radius of cam 26.

When finger 24 reaches position A, the point of abutment of lever 36 passes from portion 26*a* to portion 26*b*. Via the effect of the rapid decrease in radius of cam 26, the spring abruptly slackens, driving in rotation the finger 24-cam 26 assembly over the entire second angular sector AB.

After pivoting, finger 24 is in position B and lever 36 is abutting on portion 26*c*, which corresponds to the minimum strain position of spring 38. The finger 24-cam 26 assembly is in a stable position. This configuration is illustrated in FIG. 3. Stud 28 is now located at about two thirds of the way along aperture 34, such that drive wheel 32 stops driving the finger 24-cam 26 assembly during the period of time necessary for active end 34*a* of aperture 34 to catch up with stud 28. This period of time is typically of the order of 8 hours.

The abrupt passage of finger 24 from position A to position B has driven display member 10 through one step in rotation. For approximately 8 hours after this rotation of display member 10, finger 24 is locked in position B via the effect of spring 38, which holds lever 36 abutting against portion 26*c*. In this position, it has been observed that there is a risk of poor manipulation causing significant damage.

Indeed, the time indication display mechanism is generally provided with a quick correction device for driving display mechanism 10 directly in its current operating direction, namely clockwise in this case. When the user actuates the quick correction device while finger 24 is in position B, engaged in toothing 14, display member 10 drives finger 24 in rotation, via toothing 14. It will be noted that this manipulation is possible since stud 28 is not stopped against the passive end 34*b* of aperture 34, but at a sufficient distance for finger 24 to be able to be released from toothing 14 without being blocked by drive wheel 32.

If the quick correction device is partially actuated, finger 24 may be oriented in a singular position referenced S. In this position S, finger 24 is abutting on the tip of toothing 14, on which it exerts a significant force because of the action of spring 38, which holds lever 36 abutting on portion 26*a* of increasing radius of cam 26. Display member 10 is locked in an intermediate position, since the action of jumper spring 16, which tends to make it rotate, is not enough to counter the action of spring 38, which is locking said member This configuration is illustrated in FIG. 4.

Since finger 24 is positioned in singular position S, the user may wish to go backwards, if he observes that he should really have corrected the display in the opposite direction of rotation to the current operating direction. Generally, quick correction devices do not allow quick correction in the opposite direction of rotation, because of the high risk of breaking the display mechanism. For this reason, they are provided with disconnecting means or sliding gear means for switching the correction of one display mechanism to another, depending upon the direction of rotation However, correction in the opposite direction to the operating direction is possible via correction of the time. If, therefore, the user tries to correct the position of display member 10 in the opposite direction of rotation to the current operating direction, while finger 24 is immobilised in singular position S, this manipulation will inevitably lead to the breakage of finger 24 or part of toothing 14. The instantaneous display mechanism is then no longer operational.

SUMMARY OF THE INVENTION

It is an object of the present invention to overcome this drawback by proposing an instantaneous display mechanism wherein the singular position S is made impossible. More specifically, the invention concerns an instantaneous display mechanism for a timepiece including:

a display member provided with a toothing, mounted so as to move in rotation, positioned using a jumper spring, a drive wheel set, mounted so as to move in rotation including a cam and a finger secured to the cam in rotation, the finger cooperating with the toothing to drive the display member in steps, a spring cooperating at least indirectly with the cam, the cam being arranged to pivot the finger-cam assembly, via the unwinding action of the spring, so as to drive the display member through one step.

According to the invention, the cam is also arranged for pivoting the finger-cam assembly via the unwinding action of the spring, so as to release the finger from the toothing after the finger-cam assembly has driven the display member through one step.

Owing to this feature of the cam, finger 24 can no longer be immobilised in the singular position S wherein it blocks the rotation of display member 10. As a result, even in the event of backward correction by the user, any risk of finger 24 or toothing 14 breaking is removed.

Other features and advantages of the present invention will appear more clearly from the following detailed description of an example embodiment of an instantaneous display mechanism according to the invention, this example being given purely by way of non limiting illustration with reference to the annexed drawing.

Figure 1:
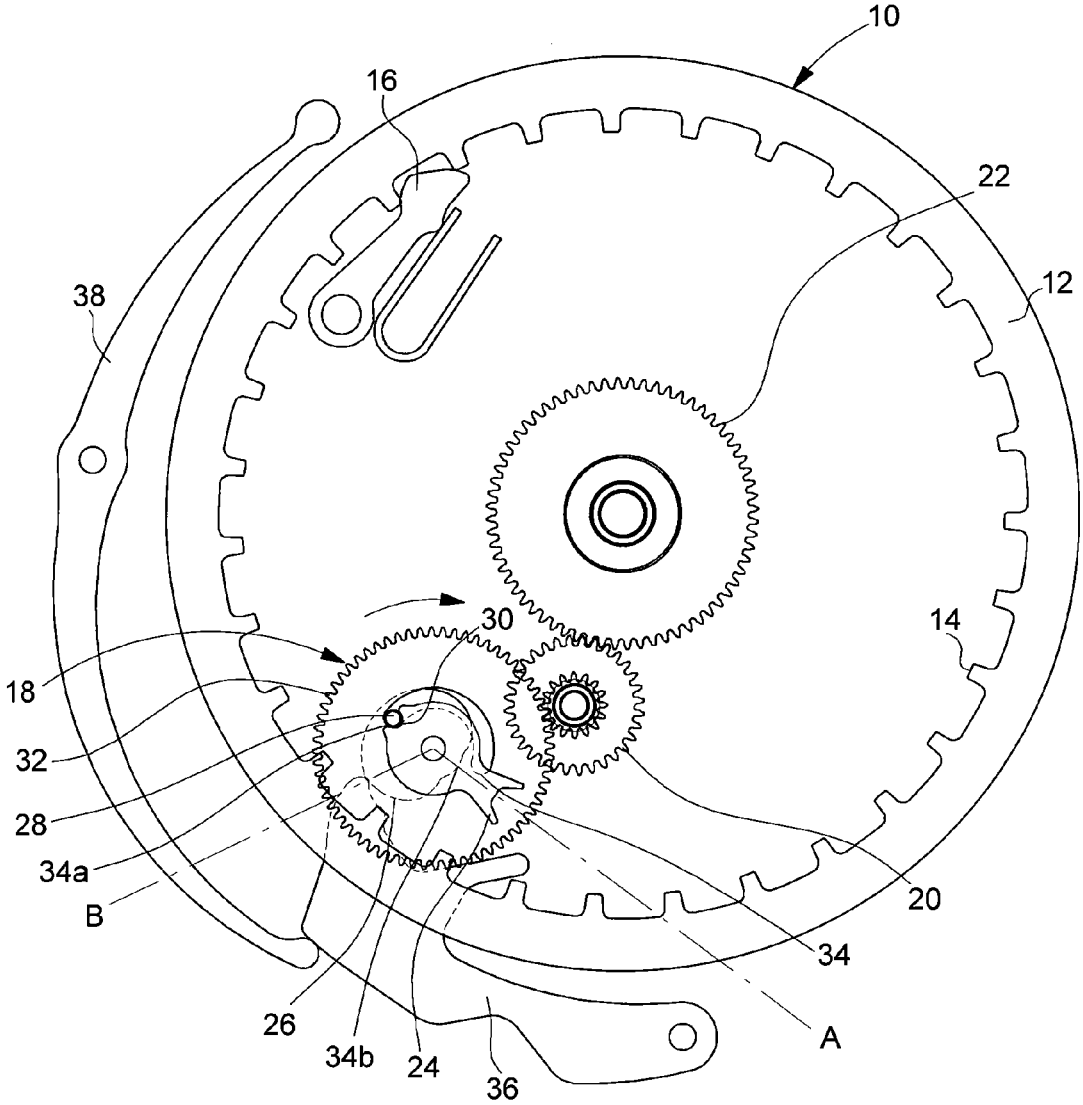
FIG. 1-4 already described show an instantaneous display mechanism.
Figure 2:
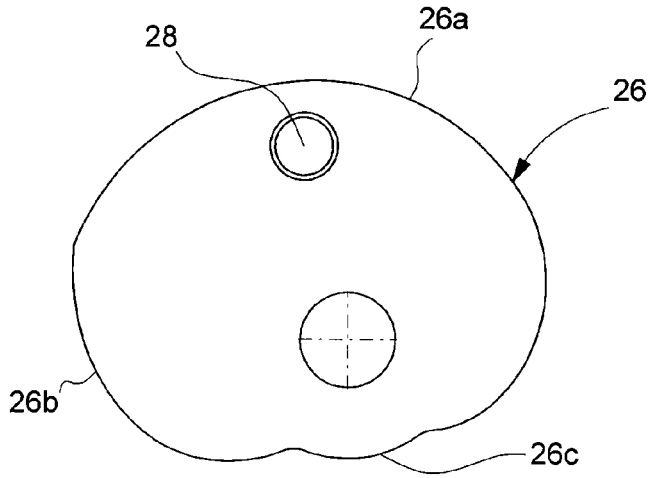
Figure 3:
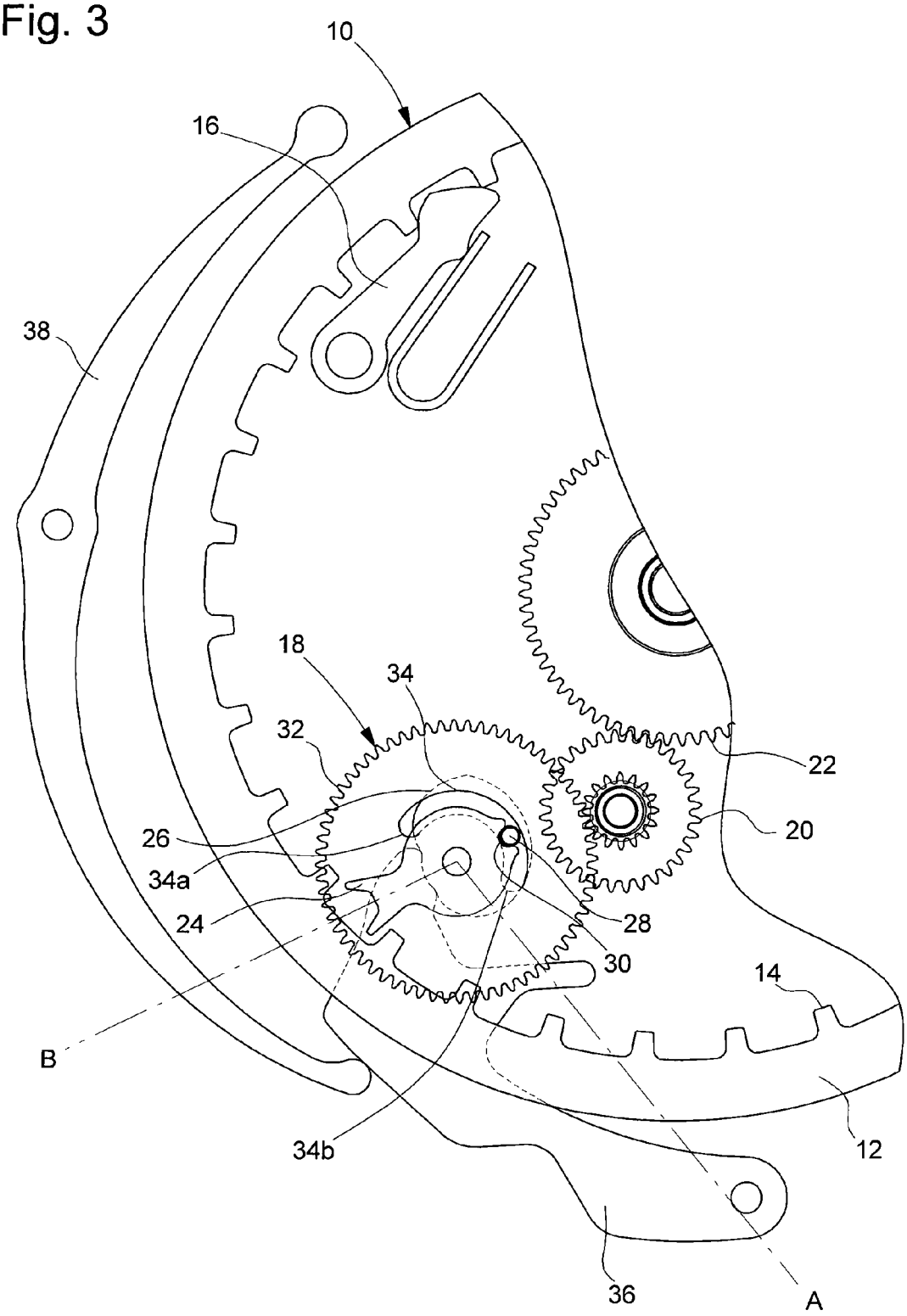
Figure 4:
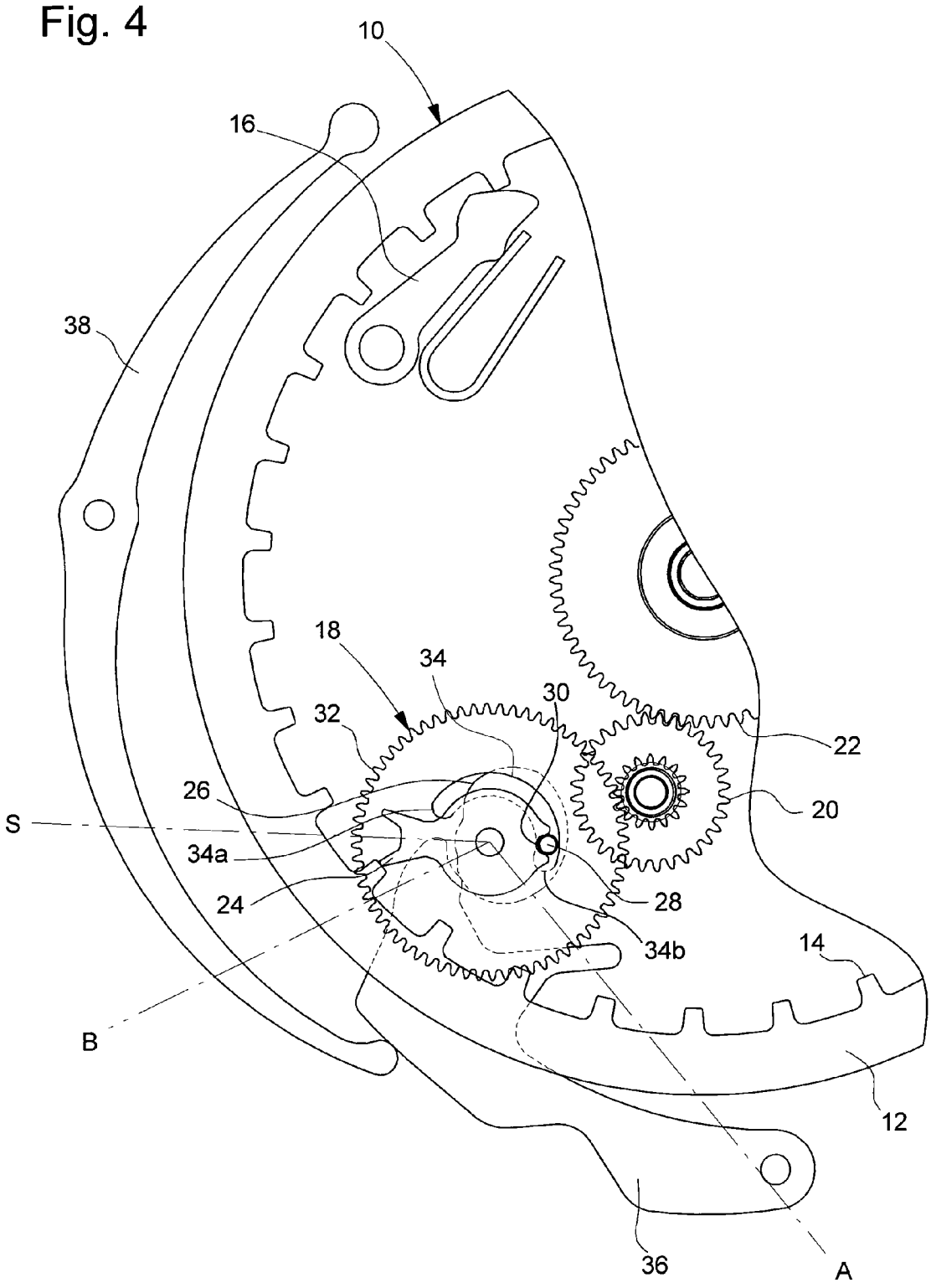
Figure 5:
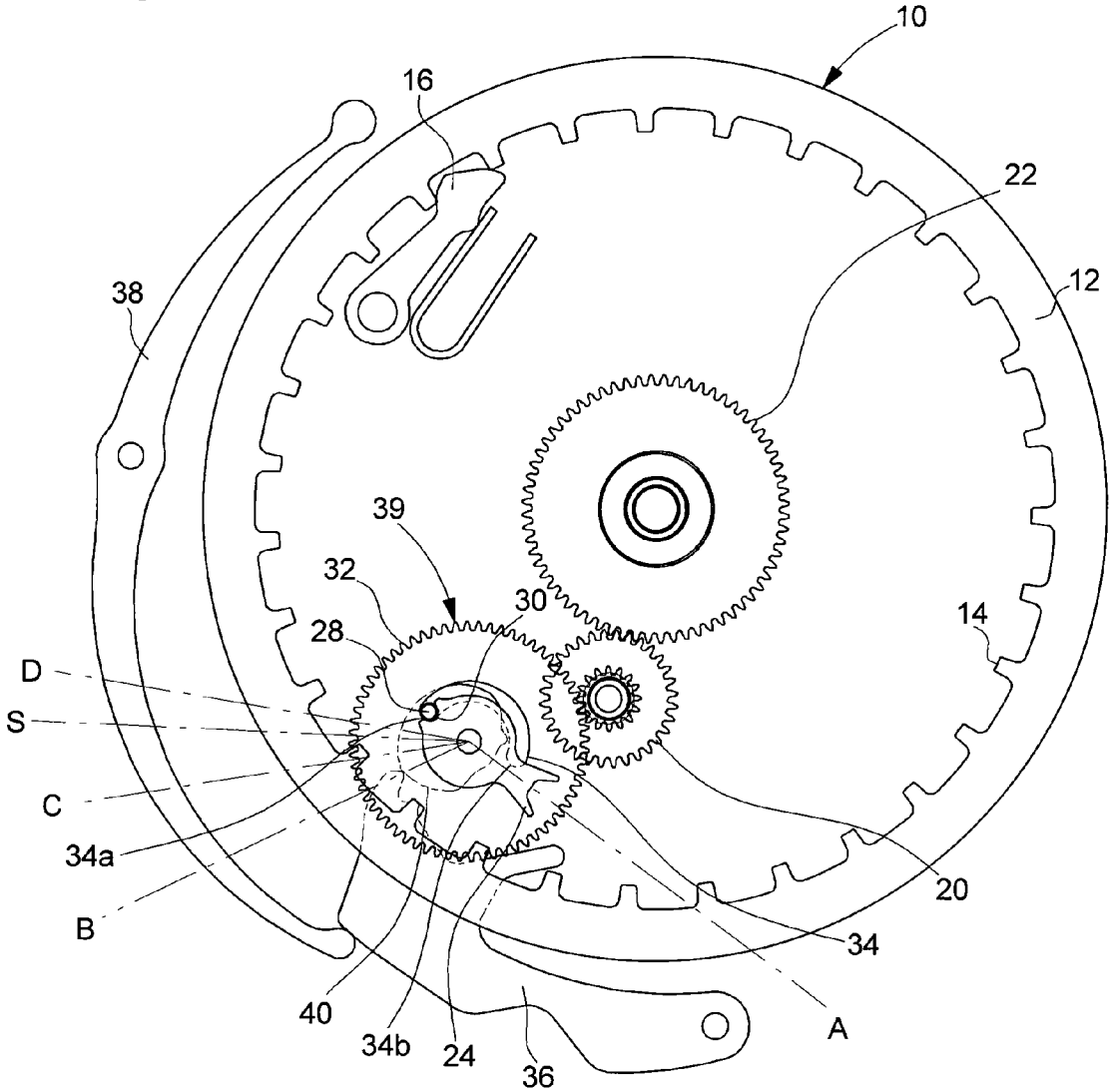
FIG. 5 is a top view of a display mechanism according to the invention.

Like the mechanism illustrated in FIGS. 1 to 4, the instantaneous display mechanism shown in FIG. 5 includes a display member 10 mounted so as to move in rotation on a plate that is not shown, angularly positioned using a jumper spring 16, and actuated in rotation by a wheel set 39. Wheel set 39 is identical to wheel set 18 described above, as regards structure, but differs as regards the features of the cam 40, shown in a top view in FIG. 6.

Figure 6:
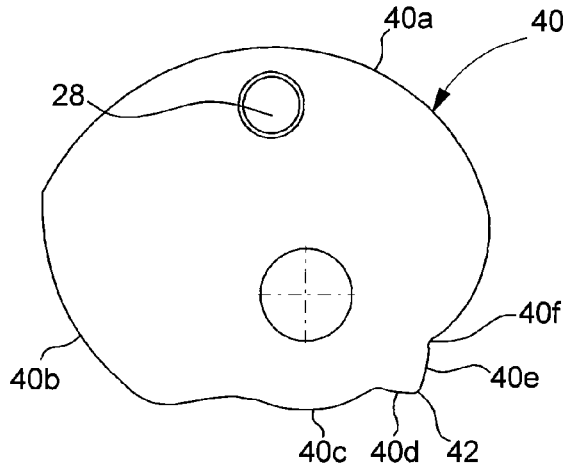
FIG. 6 is a view of a cam belonging to the display mechanism.

Like cam 26, cam 40 illustrated in FIG. 6 includes a first portion 40*a* of increasing radius, a second portion 40*b* of rapidly decreasing radius and a portion 40*c* of minimum radius. It further includes a second portion 40*d* of increasing radius and a second portion 40*e* of rapidly decreasing radius, together forming a beak 42 located between portions 40*c* and 40*a*. At the junction between portions 40*e* and 40*a* there is a point 40*f* of minimum local radius of cam 40.

The two portions 40*d* and 40*e* define two new angular sectors, respectively BC and CD, delimited by two angular positions C and D of finger 24, and they correspond to two distinct advancement modes of the finger 24-cam 40 assembly. In position C, finger 24 is oriented downstream of position B, but still engaged in toothing 14, and in position D, it is oriented downstream of position C, but released from toothing 14. The point 40*f* of minimum local radius defines a second stable position of the finger 24-cam 40 assembly, wherein finger 24 is oriented in angular position D.

Figure 7:
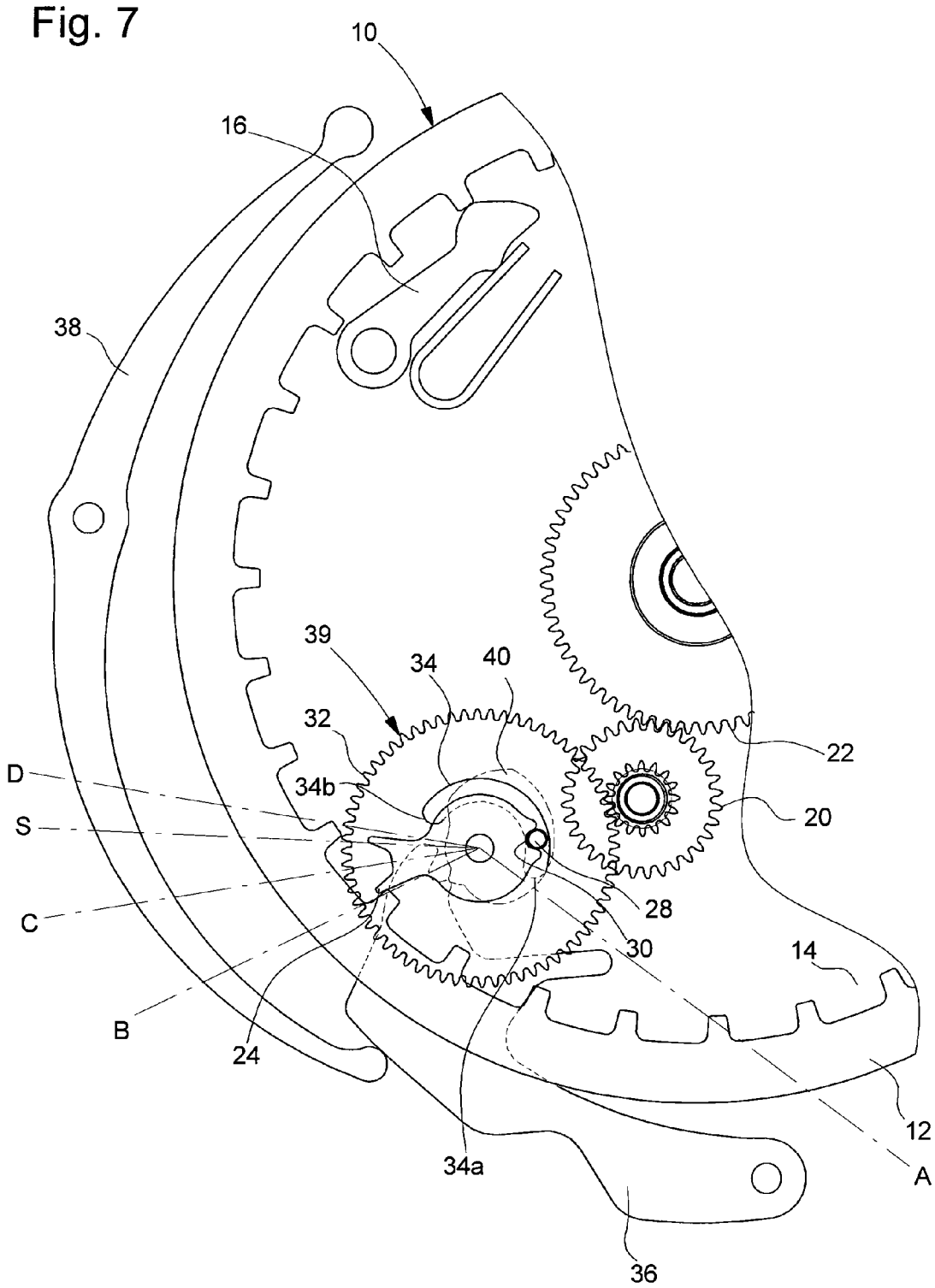
FIGS. 7 and 8 illustrate the operation of the display mechanism according to the invention.
Figure 8:
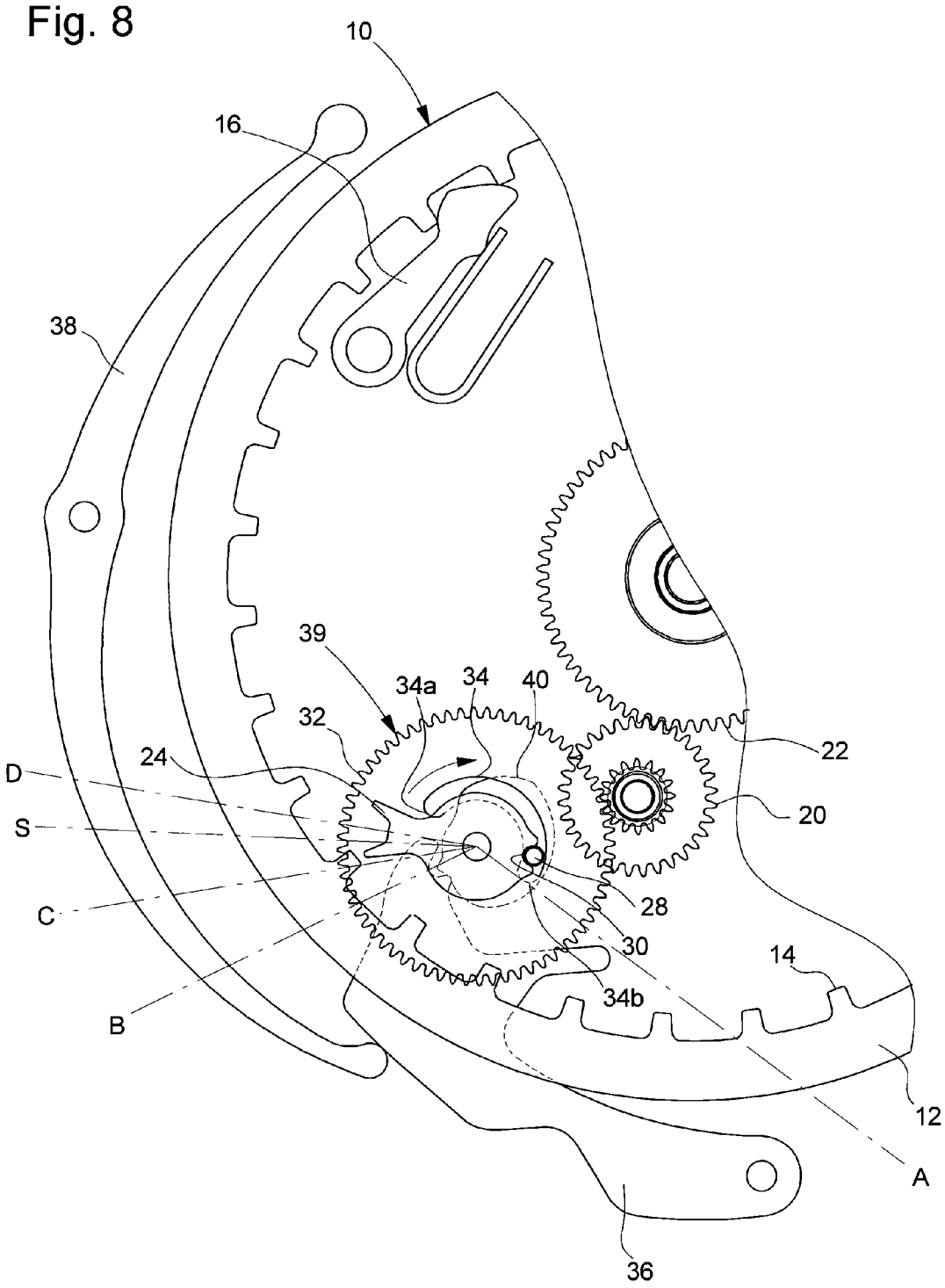

The operation of the instantaneous display mechanism provided with cam 40 is illustrated in FIGS. 7 and 8.

The cycle of rotation of wheel set 39 starts at point D. Over the first angular sector DA, the driving and operation of wheel set 39 is identical to that of wheel set 18 over sector BA. The same is true for sector AB. After pivoting over sector AB, finger 24 is in position B and lever 36 is abutting on portion 40*c*. The finger 24-cam 40 assembly occupies its first stable position, and stud 28 is located two thirds of the way along aperture 34.

When the finger is in position B, two situations may arise.

In a first situation, which particularly interests us, the user manipulates the quick correction device. Toothing 14 then drives the finger 24-cam 40 assembly via finger 24, over the angular sector BC corresponding to cam portion 40*d*. Spring 38 strains via the effect of increase in radius of cam 40. FIG. 7 illustrates this step of the rotation cycle of wheel set 39.

If the user stops his manipulation before finger 24*a* has reached or passed angular position C, the finger 24-cam 40 assembly returns, via the action of spring 38, to its first stable position wherein finger 24 occupies angular position B.

Reference will now be made to FIG. 8. If the user continues his manipulation, finger 24 passes position C, wherein it is still engaged in toothing 14, and lever 36 passes from portion 40*d* to portion 40*e*. The spring abruptly slackens via the effect of the decrease in radius of cam 40, and drives the finger 24-cam 40 assembly in rotation over the entire angular sector CD. After pivoting, finger 24 is in position D, released from toothing 14, and the finger 24-cam 40 assembly occupies its second stable position. Moreover, display member 10, driven by jumper spring 16, has rotated through one step.

Owing to the second portion 40*e* of rapidly decreasing radius, finger 24 is thus driven, without any action by the user, and without any possibility of stopping in singular position S, from an angular position C upstream of angular position S, to an angular position D downstream of singular position S. The user may then go backwards using the time correction, without any risk of breaking finger 24 or toothing 14.

In the second situation, the user does not manipulate the rapid correction device, and end 34*a* of aperture 34 catches up with stud 28 in a time period of approximately eight hours. It is then drive wheel 32 that drives the finger 24-cam 40 assembly over angular sector BC. Then the finger 24-cam 40 assembly pivots rapidly via the action of spring 38, over angular sector CD. As finger 24 is in position D, the finger 24-cam 40 assembly occupies its second stable position.

Stud 28 is now held slightly downstream of active end 34*a* of aperture 34, such that the drive wheel stops driving the finger 24-cam 40 assembly for the time period necessary for active end 34*a* of aperture 34 to catch up with stud 28. This time period is typically of the order of two hours. After these two hours, the drive wheel controls the finger 24-cam 40 assembly again, and the cycle of rotation starts again from position D.

A time indication display mechanism, free of the breakage risks that exist in known mechanisms, has thus been described. It goes without saying that the present invention is not limited to the embodiment that has just been described, and that various simple alterations and variants could be envisaged by those skilled in the art, without departing from the scope of the present invention, as defined by the annexed claims.

It will be noted, in particular, that in a simplified embodiment, the first and second portions of rapidly decreasing radius 40*b* and 40*e* of cam 40 are adjoining. The second portion 40*d* of increasing radius does not exist, and the portion of minimum radius 40*c* is merged with point 40*f* of minimum local radius.

Owing to this structure of cam 40, the finger 24-cam 26 assembly is driven in rotation by spring 38, from angular position A to angular position D, without stopping in stable position B, and without passing through another drive mode between positions B and C.

This embodiment prevents the risk of breaking finger 24 and toothing 14, in the same way as the previously described embodiment. However, it is less advantageous, since, after driving display member 10, finger 24 is no longer engaged in toothing 14. Consequently, finger 24 is no longer able to block the rotation of display member 10, and in particular to prevent the risk of several consecutive jumps.

What is claimed is:

1. An instantaneous display mechanism for a timepiece, including:

a display member fitted with a toothing mounted so as to move in rotation, and positioned using a jumper spring, a drive wheel set mounted so as to move in rotation, including a cam and a finger, wherein the finger is secured in rotation to the cam so as to provide a finger-cam assembly, wherein the finger cooperates with the toothing to drive the display member by steps, and a spring cooperating at least indirectly with the cam, wherein the cam is arranged to pivot the finger-cam assembly, via a slackening action of the spring, so as to drive the display member through one step, wherein the cam is further arranged for pivoting the finger-cam assembly, via the slackening action of the spring, so as to release the finger from the toothing after the finger-cam assembly has driven the display member through one step.

2. The display mechanism according to claim 1, wherein said cam is further arranged for holding, via the pressure action of said spring, said finger engaged in said toothing, after the finger-cam assembly has driven said display member through one step.

3. The display mechanism according to claim 1, wherein said cam includes a first portion of decreasing radius arranged for causing the finger-cam assembly to pivot, via the slackening action of said spring, so as to drive said display member through one step, and a second portion of decreasing radius arranged for causing the finger-cam assembly to pivot, via the slackening action of said spring, so as to release said finger from said toothing, after the finger-cam assembly has driven said display member through one step.

4. The display mechanism according to claim 3, wherein said cam further includes a portion of minimum radius inserted between said first and second portions of decreasing radius, and arranged for holding, via the pressure action of said spring, said finger engaged in said toothing, after finger-cam assembly has driven said display member through one step.

5. The display mechanism according to claim 1, wherein said drive wheel set further includes a drive wheel provided with an aperture in the form of an arc of a circle, in which a stud, secured to the finger-cam assembly, is engaged, said aperture cooperating with said stud to drive the finger-cam assembly in rotation or to leave said assembly free to pivot via the slackening action of said spring.

6. The display mechanism according to claim 5, wherein said cam further includes a first portion of increasing radius inserted between said second and first portions of decreasing radius, and arranged for straining said spring via the rotational drive action of the drive wheel.

7. The display mechanism according to claim 5, wherein said cam further includes a second portion of increasing radius inserted between said portion of minimum radius and said second portion of decreasing radius, and arranged for straining said spring via the rotational drive action of the drive wheel.

8. The display mechanism according to claim 3, wherein said first and second portions of decreasing radius are adjoining.

9. The display mechanism according to claim 8, wherein said drive wheel further includes a drive wheel provided with an aperture in the shape of an arc of a circle, in which a stud, secured to the finger-cam assembly, is engaged, said aperture cooperating with said stud to drive the finger-cam assembly in rotation or to leave said assembly free via the slackening action of said spring.

10. The display mechanism according to claim 9, wherein said cam further includes a portion of minimum radius arranged for holding finger released from said toothing, via the pressure action of said spring, after the finger-cam assembly has driven said display member through one step.

11. The display mechanism according to claim 2, wherein said cam includes a first portion of decreasing radius arranged for causing the finger-cam assembly to pivot, via the slackening action of said spring, so as to drive said display member through one step, and a second portion of decreasing radius arranged for causing the finger -cam assembly to pivot, via the slackening action of said spring, so as to release said finger from said toothing, after the finger-cam assembly has driven said display member through one step.

12. The display mechanism according to claim 6, wherein said cam further includes a second portion of increasing radius inserted between said portion of minimum radius and said second portion of decreasing radius, and arranged for straining said spring via the rotational drive action of the drive wheel.

* * * * *